United States Patent [19]

Johnson

[11] 4,435,165

[45] Mar. 6, 1984

[54] FLOTATION DEVICE FOR SUPPORTING A PERSON IN WATER

[75] Inventor: James E. Johnson, Cheltenham, England

[73] Assignee: J. E. Johnson & Sons (Engineers) Limited, Cheltenham, England

[21] Appl. No.: 169,755

[22] Filed: Jul. 17, 1980

[30] Foreign Application Priority Data

Jul. 31, 1979 [GB] United Kingdom ..... 7926682

[51] Int. Cl.[3] ..... B63C 9/08

[52] U.S. Cl. ..... 441/130; 441/88

[58] Field of Search ..... 434/254; 114/61, 56, 114/39, 267, 123; 272/71; 440/21, 24–32; 9/310 R, 310 J, 311, 6 R, 347, 348, 349; 441/88, 129, 130, 126

[56] References Cited

U.S. PATENT DOCUMENTS 1,099,575 6/1914 Skaszynski ..... 441/65

3,179,080 4/1965 Campbell ..... 9/310 J 3,420,202 1/1969 Oversmith ..... 114/315

3,902,443 9/1975 McDougall ..... 114/39

3,926,136 12/1975 Shroyer ..... 114/364

FOREIGN PATENT DOCUMENTS 590138 11/1925 France ..... 9/347

*Primary Examiner*—Trygve M. Blix

*Assistant Examiner*—Ivy M. Shum

*Attorney, Agent, or Firm*—Young & Thompson

[57] ABSTRACT

A flotation device for supporting a person in water comprises an elongate tubular frame including at least one body-support member, and front and rear float assemblies mounted on the frame. The rear float assembly comprises two float elements spaced apart transversely of the elongate frame, and the float elements are so disposed that, when the device is floating in the water, the body-support member is below water level, so that a person using the device is partly in the water.

13 Claims, 3 Drawing Figures

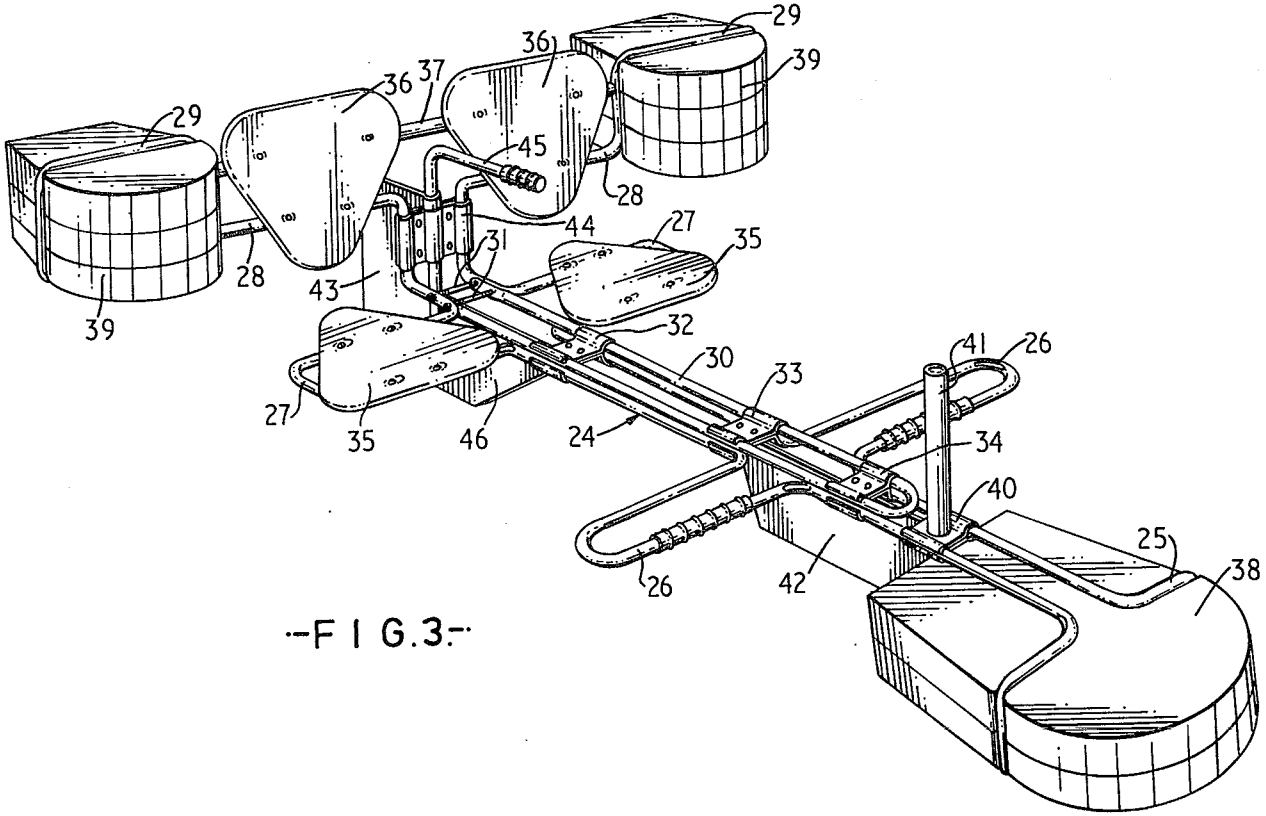
-FIG.3-

FLOTATION DEVICE FOR SUPPORTING A PERSON IN WATER

BACKGROUND OF THE INVENTION

The invention relates to flotation devices for supporting a person in water.

In particular, the invention sets out to provide a flotation device for supporting a person partly immersed in water so that the device may be used safely by persons unable otherwise to support themselves in the water through not knowing how to swim or through infirmity or physical disability. The flotation device according to the invention has general application as a water sporting device, for amusement, but may also be useful for teaching and therapeutic purposes.

SUMMARY OF THE INVENTION

According to the invention, a flotation device for supporting a person in water comprises an elongate frame including at least one body-support member, and front and rear float assemblies mounted on the frame, at least one of said float assemblies comprising two float elements spaced apart transversely of the elongate frame, the float elements being so disposed that, when the device is floating in the water, the body-support member is below water level.

Thus, in use, the person using the device and being supported by the body-support member has the benefit and experience of being partly immersed in water but at the same time has the advantage of being safely supported. In particular, the provision of the transversely spaced float elements provides lateral stability to the device.

The two transversely spaced float elements are preferably separately formed and are connected to the elongate frame by rear mounting elements, although they could also comprise portions of a single, larger float element. The front float assembly may comprise a single float element disposed on the longitudinal axis of the frame and may be connected to the frame by a front mounting element.

Each float element may comprise a body of buoyant material connected to said mounting elements. For example the buoyant material may comprise cross-linked closed cell polyethylene foam.

Each mounting element may be shaped to define an aperture into which said body of buoyant material is received. For example, the mounting element may be bent into a loop to define said aperture.

The body of buoyant material may include a portion of reduced cross-sectional area between two portions of greater cross-sectional area, whereby the buoyant material may be retained in the aperture by forcing it through the aperture until the portion of reduced cross-sectional area is disposed within the aperture.

The body-support member may comprise a substantially flat panel on which a person may sit or lie. It may further comprise an additional panel disposed at an angle to the first panel for use as a back rest by a person sitting on the first said panel.

The front and/or rear mounting elements are preferably adjustably mounted on the elongate frame whereby the positions of the float elements may be adjusted with respect to one another and to the body-support member. Preferably the rear mounting elements are adjustable so as to bring the rear float elements closer to or further from the body-support member so as to adjust the distance below water level of the body-support when the device is floating. Preferably the rear mounting elements are also adjustable so as to move the rear float elements toward or away from one another.

The device may incorporate laterally extending hand grips in addition to the aforesaid body-support member.

In a version of the device usable by two people, the elongate frame includes two body-support members symmetrically disposed on either side of the central longitudinal axis of the frame.

BRIEF DESCRIPTION OF THE DRAWINGS

FIG. 3 is a perspective view of a modified form of the device, suitable for use by two people.

DETAILED DESCRIPTION OF THE PREFERRED EMBODIMENTS

In each of the embodiments, the device comprises a main elongate frame, and front and rear float mounting elements, formed from aluminium tubing the open ends of the tubing, where appropriate, being plugged with polypropylene end caps.

Figure 1:
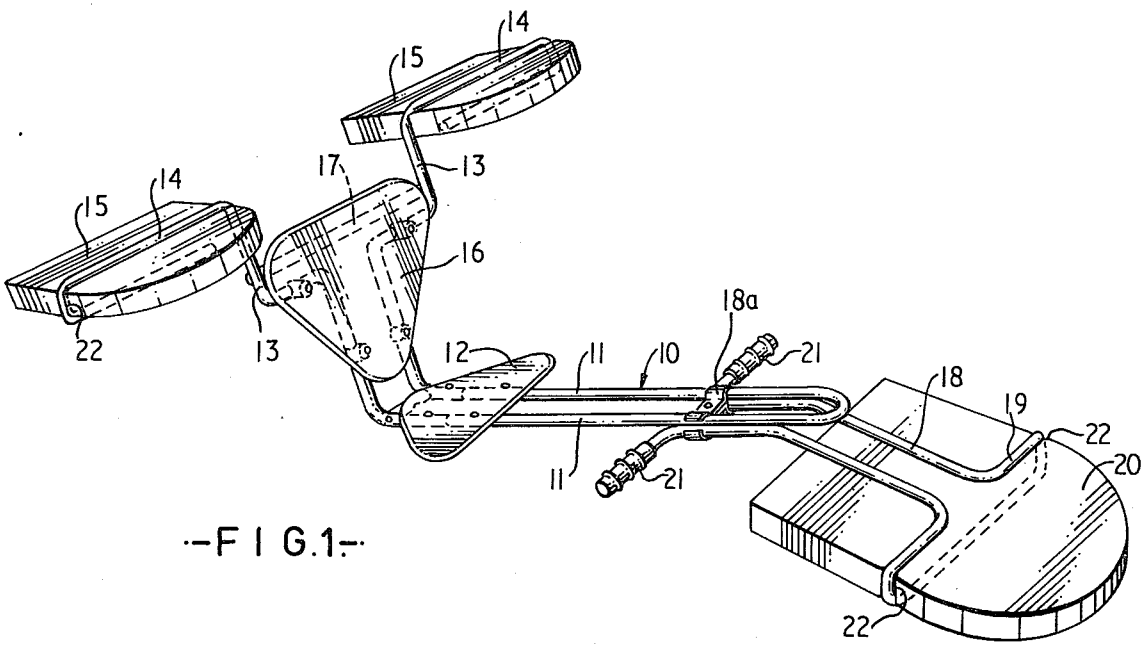
FIG. 1 is a perspective view of a flotation device according to the invention.
Figure 2:
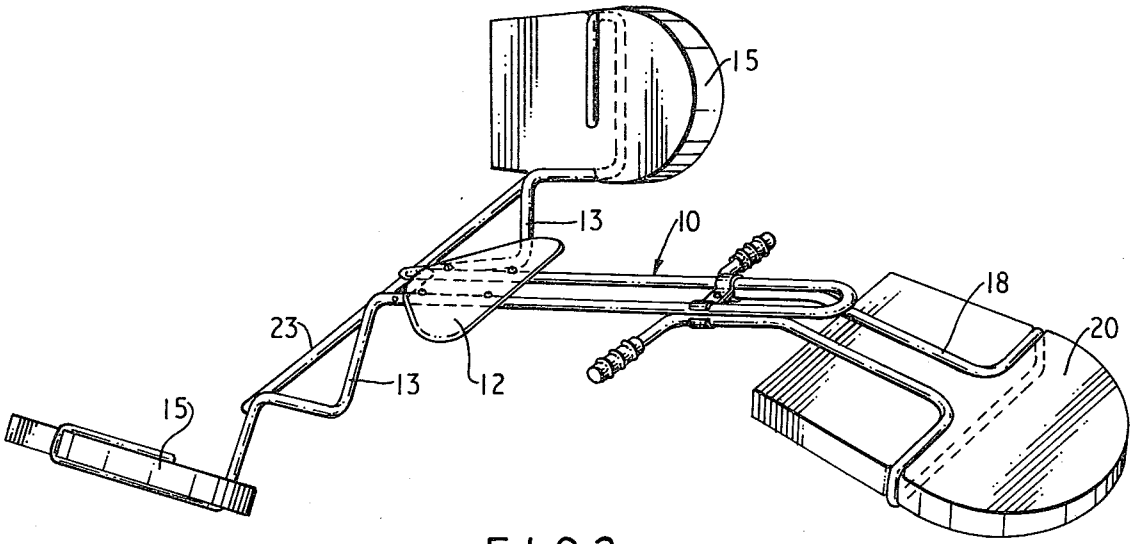
FIG. 2 is a similar view of the device of FIG. 1, showing an alternative arrangement of the components of the device.

In the embodiment of FIGS. 1 and 2, the main frame 10 is in the form of an elongated U, the limbs 11 of the U extending rearwardly and having a triangular seat panel 12 mounted across the rear ends thereof. The rear mounting elements 13 are bolted to the rear ends of the limbs respectively, and extend upwardly at right angles thereto and then downwardly away from one another. The free ends of the mounting elements are bent to form horizontally flattened loops 14. A panel 15 of cross-linked closed cell polyethylene foam is wedged through each of the flattened loops 14 to form one of the rear float elements. A back rest in the form of a further triangular metal panel 16 is secured to the parallel portions of the mounting elements extending at right angles to the frame, and a horizontal stay 17 is bolted between the upper ends of the mounting elements 13.

Secured to the front closed end of the U-shaped frame 10 by a bolted clamp **18*a* is a front mounting element 18 also bent from aluminium tubing to provide two spaced parallel forwardly and downwardly extending arms terminating in a horizontally flattened loop 19 which extends transversely of the axis of the frame 10. A further panel 20 of polyethylene foam is received in the flattened loop 19 to form the front float element. The rear ends of the arms of the front mounting element are bent laterally outwardly away from one another to form hand grips or foot rests 21**.

The panels of foam forming the float elements 15 and 20 are rounded at the front and taper rearwardly and are formed partway along their longitudinal sides with notches 22 so as to define a central area of reduced cross-section. Each panel may thus be retained in its associated loop by forcing the panel through the loop until the aluminum tubing snaps into the notches.

The connection between the front mounting element and the frame 10 is adjustable. The clamp **18*a* may be loosened so that the front mounting element may be slid forwardly or rearwardly with respect to the frame, and the clamp 18*a*** then re-tightened.

In use, the floats 15, 20 rest at the surface of the water and the seat 12 and back rest 16 are disposed below water level so that a person sitting on the seat is partly immersed in the water. The device may then be propelled forward or backwards by use of the hands and/or feet, or by use of oars or a paddle, or by a sail (not shown) carried by a mast mounted at the forward end of the main frame 10. The device may also be used for surfing. Due to the lateral spacing of the rear float elements, and the low positioning of its centre of gravity, the device is very stable even in rough water thus making it easy to get on to or off the device.

Where a lesser degree of immersion in the water is required, the horizontal stay 17 connecting the rear mounting elements 13 may be replaced by a longer horizontal stay 23, as shown in FIG. 2. In the arrangement shown in that figure, the rear mounting elements 13 are interchanged and swung outwardly and downwardly so as to lower the rear float elements 15 with respect to the seat 12 so that, in use, the seat is a shorter distance below water level. In this case the back rest 16 is removed to permit the swinging apart of the rear mounting elements 13.

FIG. 3 shows an alternative form of flotation device in accordance with the invention, suitable for use by two people at the same time.

In this arrangement the main elongate frame 24 is formed from a single length of aluminium tubing bent so as to provide a front horizontally flattened loop 25, laterally extending U-shaped hand grips or foot rests 26, rear U-shaped laterally extending seat supports 27 and rear upwardly and laterally extending mounting elements 28 formed with rear horizontally flattened loops 29.

An elongate U-shaped strengthening member 30, also formed from aluminium tubing, overlies the longitudinal portions of the main frame 24 and extends from a point to the rear of the seat supports 27 to a point forwardly of the hand grips or foot rests 26. The strengthening member 30 is bolted to the main frame at its rear end by bolts 31 and is also clamped thereto by spaced clamps 32, 33 and 34.

Triangular seat panels 35 are mounted on the seat supports 27 and triangular back rest panels 36 are mounted on the rear mounting elements 28 and on a horizontal stay 37 extending between them.

Two panels of cross-linked closed cell polyethylene foam, similar to the panels 15 and 20 of the FIG. 1 arrangement are wedged into the flattened loop 25 to form a front float element 38, and three panels of foam are wedged into each of the loops 29 to form rear float elements 39.

The flotation device may be used by two people, one occupying each seat, in similar fashion to the single seat version shown in FIG. 1. Since the people sitting on the device are partly immersed in the water, most of their weight is supported by the water and consequently there is little tendency for the device to list if there should be a disparity in weight between the two people using it.

The device may also be used with a sail and for this purpose there is provided a front clamp 40 from which extends upwardly a socket 41 to receive the lower end of a mast (not shown). A keet 42 is formed on the lower part of the clamp 40 and may be connected at its rearward end to the clamp 33. Any suitable form of sail may be carried by the mast, there being provided, in conventional fashion, a rearwardly extending swinging boom having its rearward end a mainsheet controlled by one of the people using the device.

To provide the necessary control of the device when used with a sail, there is provided a rudder 43 pivotally mounted on a clamp 44 connecting the rear mounting elements 28. The rudder is controlled by a tiller 45 projecting forwardly between the two seats 35 for use by either person on the device.

A further keel plate 46 may be mounted beneath the seats for additional stability, and may conveniently be mounted on the clamps 44 and 32.

It will be appreciated that in any of the arrangements described above the device may be easily broken down into its component parts for transport and storage by releasing the various clamps holding the component parts together.

I claim:

1. A flotation device for supporting a person in water comprising an elongate frame including at least one body-support member, and front and rear float assemblies mounted on the frame, at least one of said float assemblies comprising two float elements spaced apart transversely of the elongate frame, and locating means on the frame providing a push-fit connection between the float elements and the frame, whereby the float elements are easily attachable and detachable to and from the frame by hand, each float element comprising a body of buoyant material connected to the elongate frame by a respective mounting element, each mounting element being shaped to define an aperture into which said body of buoyant material is received, each mounting element being round aluminum tubing bent into a loop to define said aperture, each body of buoyant material including notches between two portions of greater cross-sectional area, the buoyant material being retained in the aperture by forcing it through the loop of bent aluminum tubing until the tubing snaps into the notches.

2. A flotation device according to claim 1, wherein the two transversely spaced float elements are separately formed and are connected to the elongate frame by rear mounting elements.

3. A flotation device according to claim 1, wherein the front float assembly comprises a single float element disposed on the longitudinal axis of the frame and connected to the frame by a front mounting element.

4. A flotation device according to claim 1, wherein the buoyant material comprises cross-linked closed cell polyethylene foam.

5. A flotation device according to claim 1, wherein the body-support member comprises a substantially flat panel on which a person may sit or lie.

6. A flotation device according to claim 5, wherein the body-support member further comprises an additional panel disposed at an angle to the first said panel for use as a back rest by a person sitting on the first said panel.

7. A flotation device according to claim 2, wherein the rear mounting elements are adjustably mounted on the elongate frame whereby the positions of the float elements may be adjusted with respect to one another and to the body-support member.

8. A flotation device according to claim 7, wherein the rear mounting elements are adjustable so as to bring the rear float elements closer to or further from the body-support member so as to adjust the distance below water level of the body-support member when the device is floating.

9. A flotation device according to claim 8, wherein the rear mounting elements are also adjustable so as to move the rear float elements towards or away from one another.

10. A flotation device according to claim 3, wherein the front mounting element is adjustably mounted on the elongate frame whereby the position of the front float element may be adjusted with respect to the body-support member.

11. A flotation device according to claim 1, and incorporating laterally extending hand grips in addition to the aforesaid body-support member.

12. A flotation device according to claim 1, wherein the elongate frame includes two body-support members symmetrically disposed on either side of the central longitudinal axis of the frame.

13. A flotation device according to claim 1, further including a sail mounting device and a rudder mounted on the elongate frame.

* * * * *